US008408668B2

(12) United States Patent
Furuhata

(10) Patent No.: US 8,408,668 B2
(45) Date of Patent: Apr. 2, 2013

(54) RECORDING APPARATUS

(75) Inventor: Yoshiharu Furuhata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 336 days.

(21) Appl. No.: 12/749,013

(22) Filed: Mar. 29, 2010

(65) Prior Publication Data

US 2010/0265290 A1 Oct. 21, 2010

(30) Foreign Application Priority Data

Apr. 20, 2009 (JP) ..... 2009-101973

(51) Int. Cl.
*B41J 29/38* (2006.01)

(52) U.S. Cl. ..... 347/11

(58) Field of Classification Search ..... 347/11
See application file for complete search history.

(56) References Cited

U.S. PATENT DOCUMENTS

| | | | | |
|---|---|---|---|---|
| 2007/0139487 | A1* | 6/2007 | Sekiguchi | 347/70 |
| 2007/0200885 | A1 | 8/2007 | Hibi | |
| 2008/0238974 | A1 | 10/2008 | Takahashi | |

FOREIGN PATENT DOCUMENTS

| | | | |
|---|---|---|---|
| JP | H11-300966 | A | 11/1999 |
| JP | 2001-088293 | A | 4/2001 |
| JP | 2003-080702 | A | 3/2003 |
| JP | 2004-291457 | A | 10/2004 |
| JP | 2005-104107 | A | 4/2005 |
| JP | 2007-253618 | A | 10/2007 |
| JP | 2008-229890 | A | 10/2008 |
| JP | 2008-246810 | A | 10/2008 |

OTHER PUBLICATIONS

Japan Patent Office, Notice of Reasons for Rejection for Japanese Patent Application No. 2009-101973 (counterpart to above-captioned patent application), mailed Aug. 17, 2011.

* cited by examiner

*Primary Examiner* — Julian Huffman
(74) *Attorney, Agent, or Firm* — Baker Botts L.L.P.

(57) ABSTRACT

A record head has an actuator which is selectively switchable between a small-capacity state in which the capacity of a pressure chamber connected to an outlet is V1 and a large-capacity state in which the capacity of the pressure chamber is V2 which is larger than V1. A head driving unit selectively supplies, to the actuator, ejection drive signals which change the state of the actuator to eject liquid from the outlet and non-ejection drive signals by which the state of the actuator is changed from the small-capacity state to the large-capacity state and then returns to the small-capacity state, to the extent that no ejection of the liquid occurs from the outlet. The head driving unit successively supplies the non-ejection drive signals to the actuator while causing at least one of a first time and a second time to repeatedly increase and decrease in length, the first time being a time from an increase timing at which the state is changed from the small-capacity state to the large-capacity state to a decrease timing at which the state is changed from the large-capacity state to the small-capacity state, and the second time being a time ranging from an input of a non-ejection drive signal to an input of a directly-subsequent non-ejection drive signal.

6 Claims, 12 Drawing Sheets

RECORDING APPARATUS

CROSS REFERENCE TO RELATED APPLICATION

The present application claims priority from Japanese Patent Application No. 2009-101973, which was filed on Apr. 20, 2009 the disclosure of which is herein incorporated by reference in its entirety.

BACKGROUND OF THE INVENTION

Among recording apparatuses ejecting liquid from outlets, there are conventional recording apparatuses arranged so that the increase in the viscosity on account of drying of liquid is restrained by vibrating the meniscus of the liquid by driving an actuator to the extent that the liquid is not ejected from the outlet. For example, according to one technology, the vibration of the meniscus is stabilized by supplying a micro vibration signal which instructs to vibrate the meniscus to the actuator so that intervals of vibrational excitations are shortened stepwise.

SUMMARY OF THE INVENTION

The above-described arrangement in which the intervals of vibrational excitations are shortened stepwise may stabilize the vibration. However, since the intervals of vibrational excitations are gradually shortened and hence the intervals are long during the early stage, the liquid is not speedily stirred. It is therefore impossible to effectively restrain the increase in the viscosity of the liquid.

An objective of the present invention in consideration of the problem above is to provide a recording apparatus which can easily restrain the increase in the viscosity of liquid.

To achieve this objective, a recording apparatus of the present invention includes: a record head which includes an outlet to eject a liquid, a pressure chamber connected to the outlet, and an actuator which is selectively switchable between a small-capacity state in which the capacity of the pressure chamber is V1 and a large-capacity state in which the capacity of the pressure chamber is V2 which is larger than V1; and a head driving unit which selectively supplies, to the actuator, an ejection drive signals which change the state of the actuator so that the liquid is ejected from the outlet and non-ejection drive signals by which the state of the actuator is changed from the small-capacity state to the large-capacity state and then returns to the small-capacity state, to the extent that no ejection of the liquid occurs from the outlet, wherein, the head driving unit successively supplies the non-ejection drive signals to the actuator while causing at least one of a first time and a second time to repeatedly increase and decrease in length, the first time being a time from an increase timing at which the state of the actuator is changed from the small-capacity state to the large-capacity state to a decrease timing at which the state of the actuator is changed from the large-capacity state to the small-capacity state, and the second time being a time ranging from an input of a non-ejection drive signal to an input of a directly-subsequent non-ejection drive signal.

DESCRIPTION OF THE PREFERRED EMBODIMENTS

A preferred embodiment of the present invention will be described with reference to figures.

Figure 1:
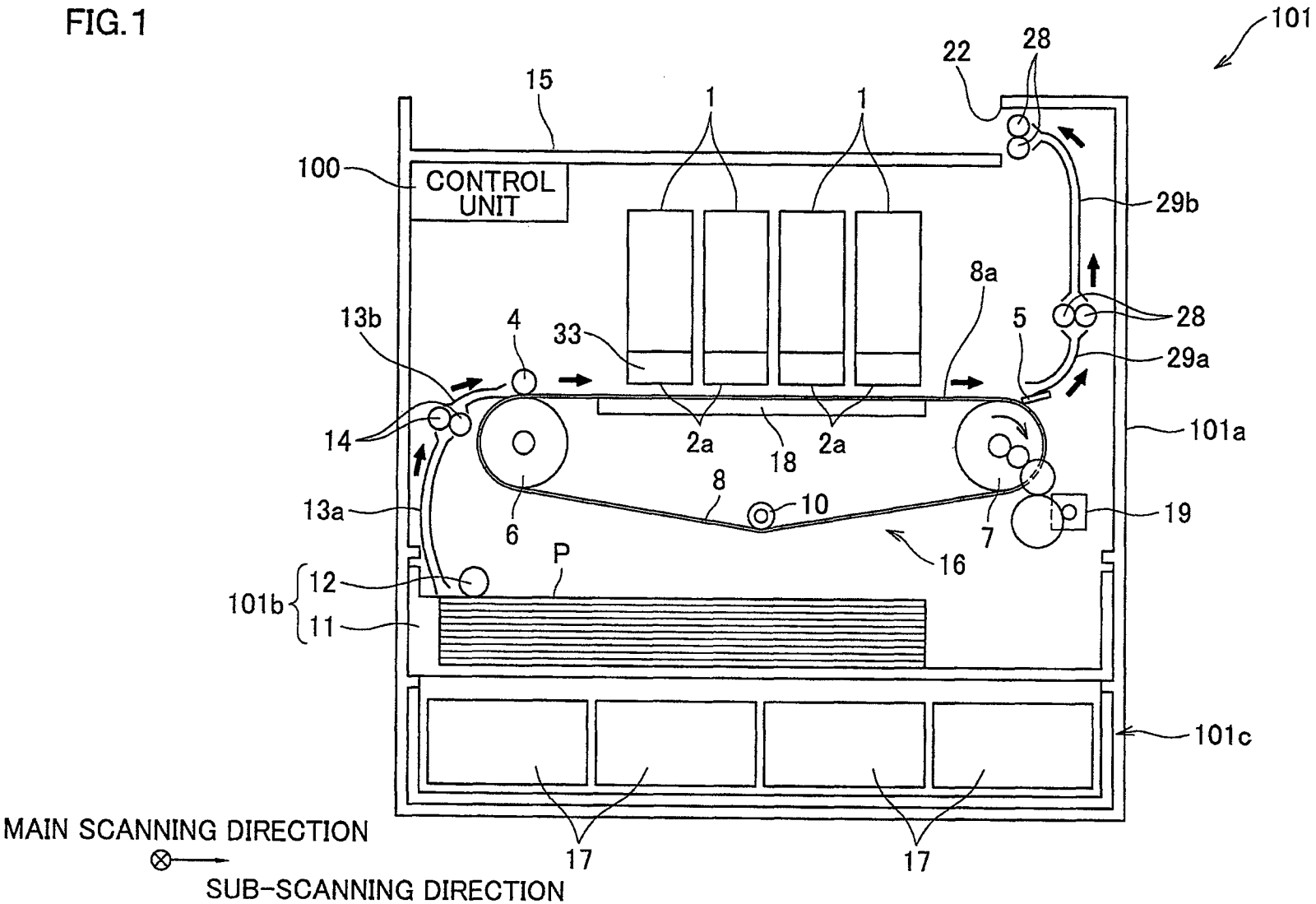
FIG. 1 is a schematic diagram of the internal structure of an inkjet printer of an embodiment according to the present invention.

As shown in FIG. 1, the inkjet printer 101 has a rectangular parallelepiped chassis 101*a*. In this chassis 101*a* are provided four inkjet heads 1 ejecting magenta, cyan, yellow, and black inks, respectively, and a conveyor mechanism 16. On the inner surface of the top plate of the chassis 101*a* is provided a control unit 100 which controls the operations of the components such as the heads 1 and the conveyor mechanism 16. Above the top plate is provided a sheet discharge unit 15, and sheets P on which images are formed are ejected thereto. Below the conveyor mechanism 16 is provided a sheet supply unit 101*b* which is detachable from the chassis 101*a*. Below the sheet supply unit 101*b* is provided an ink tank unit 101*c* which is detachable from the chassis 101*a*.

Inside the inkjet printer 101, a sheet conveyance path is formed along the thick arrow in FIG. 1, and sheets P are transported thereon from the sheet supply unit 101*b* to the sheet discharge unit 15. The sheet supply unit 101*b* includes a sheet feeding tray 11 and a sheet feeding roller 12. The sheet feeding tray 11 looks like an open-top box, and sheets P are stacked therein. The sheet feeding roller 12 sends out the topmost sheet P from the sheet feeding tray 11. The sheet P thus sent out is supplied to the conveyor mechanism 16 while being guided by guides 13*a* and 13*b* and pinched by a feed roller pair 14.

The conveyor mechanism 16 includes two belt rollers 6 and 7, a conveyor belt 8, a tensioning roller 10, and a platen 18. The conveyor belt 8 is an endless belt looped around the rollers 6 and 7. The tensioning roller 10 is, at the lower loop of the conveyor belt 8, biased downward while contacting the inner surface of the belt, so that the conveyor belt 8 is tensioned. The platen 18 is provided inside the region enclosed in the conveyor belt 8, and prevents the conveyor belt 8 from flexing downward at a part of the belt opposing the heads 1. The belt roller 7 which is a driving roller rotates clockwise in FIG. 1, as a driving force is supplied to the shaft from a conveyor motor 19. The belt roller 6 which is a driven roller rotates clockwise in FIG. 1, as the conveyor belt 8 is moved by the rotation of the belt roller 7. The driving force of the conveyor motor 19 is transmitted to the belt roller 7 via gears.

The outer surface 8*a* of the conveyor belt 8 is sticky on account of silicone treatment. To oppose the belt roller 6, a nipping roller 4 is provided. This nipping roller 4 presses a sheet P supplied from the sheet supply unit 101*b* onto the outer surface 8*a* of the conveyor belt 8. The sheet P is kept on the outer surface 8*a* on account of its stickiness and conveyed in the sheet conveyance direction (i.e. in the direction to the right in FIG. 1, which is identical with the sub-scanning direction).

To oppose the belt roller 7, a peeling plate 5 is provided. This peeling plate 5 peels a sheet P off from the outer surface 8*a*. The sheet P having been peeled off is conveyed while being guided by guides 29*a* and 29*b* and being pinched by two feed roller pairs 28. The sheet P is then discharged to a sheet discharge unit 15 formed on the upper surface of the top plate of the chassis 101*a*, from a discharging slot 22 at the upper part of the chassis 101*a*.

The four heads 1 eject inks having different colors (magenta, yellow, cyan, and black), respectively. Each of these four heads 1 is substantially rectangular parallelepiped and long in the main scanning direction. Furthermore, the four heads 1 are fixedly aligned along the conveyance direction A of the sheet P. In other words, the printer 101 is a line-type printer and hence the conveyance direction A is orthogonal to the main scanning direction.

Figure 3:
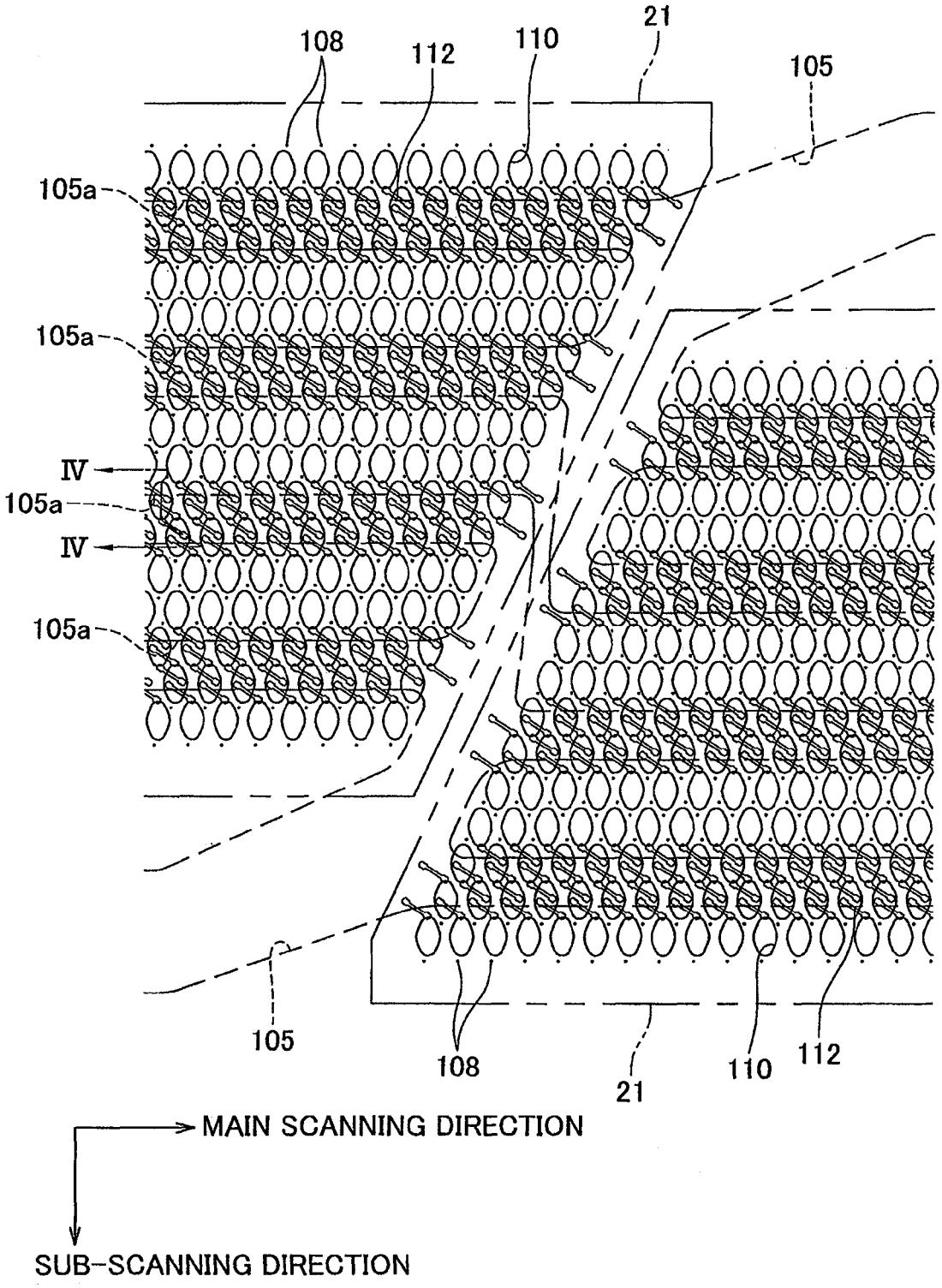
FIG. 3 is an enlarged view of a part around the border of two actuator units which neighbor each other in FIG. 2.

The lower part of the head 1 is a head main body 33 having outlets 33 which eject ink (see FIG. 3). The outlets 108 are formed on an ejection surface 2*a* which is the lower surface of the head main body 33. While a conveyed sheet P passes through the regions immediately bellow the respective heads 1, the inks having the respective colors are ejected from the outlets 108 to the upper surface of the sheet P in sequence. As a result, a desired color image is formed on the upper surface, i.e. the printing surface of the sheet P.

Each head 1 is connected to an ink tank 17 inside the ink tank unit 101*c*. The four ink tanks 17 store inks having different colors, respectively. From each ink tank 17, ink is supplied to the head 1 via a tube.

Now, the head main body 33 will be described with reference to FIG. 2 to FIGS. 5A and 5B. In FIG. 3, the apertures 112 are indicated by full lines rather than dotted lines, for the sake of readability.

Figure 2:
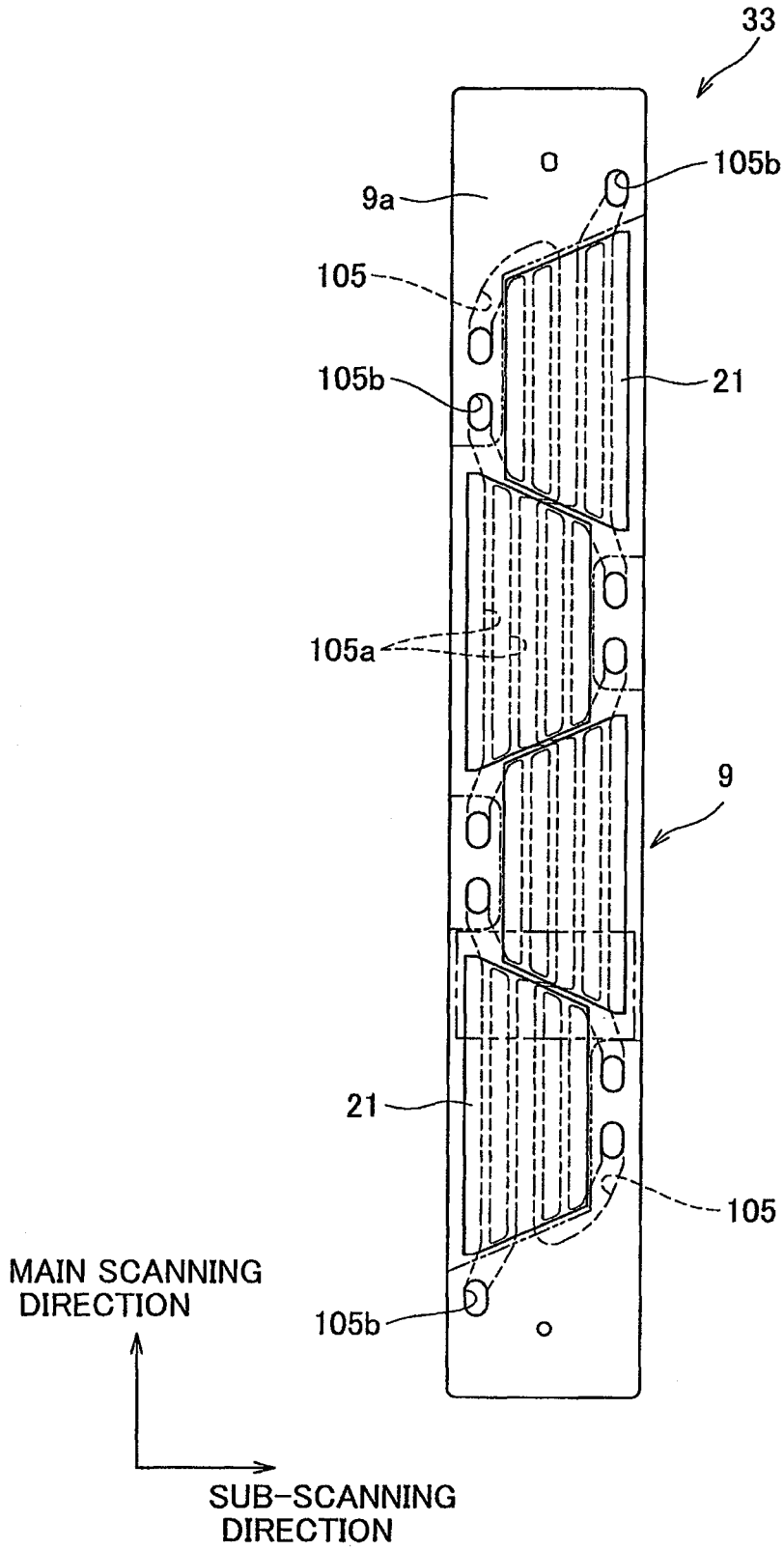
FIG. 2 is a plan view of the head main body of FIG. 1.

As shown in FIG. 2, the head main body 33 includes a path unit 9 and four actuator units 21 fixed to the upper surface 9*a* of the path unit 9. As shown in FIG. 3, the path unit 9 has an ink path therein. The actuator unit 21 is trapezoidal shape in plan view. The actuator unit 21 includes actuators corresponding to the respective pressure chambers 110, and selectively imparts ejection energy to the ink in the pressure chambers 110.

Figure 4:
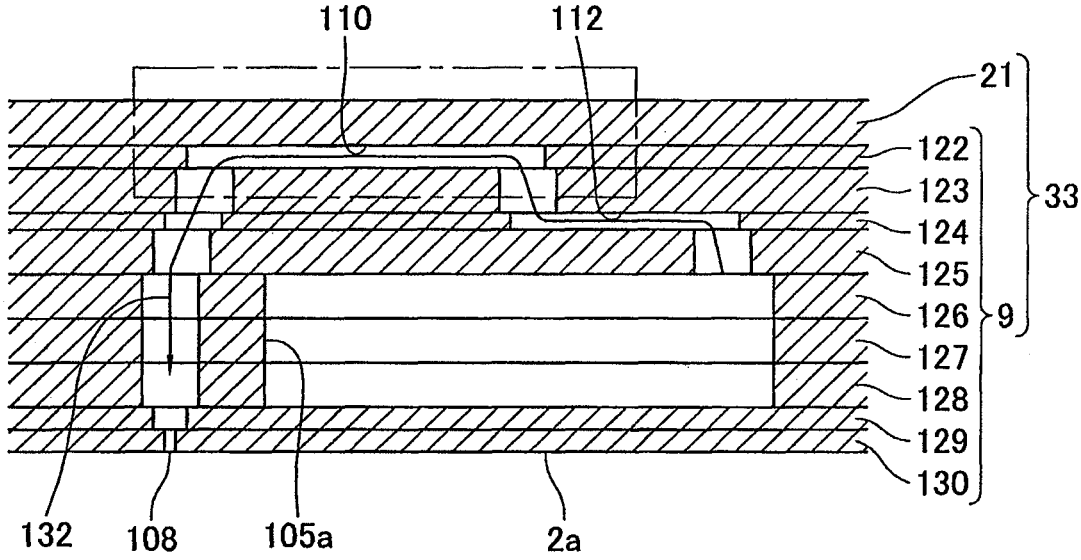
FIG. 4 is a cross section of the path unit of FIG. 3, taken at line IV-IV of FIG. 3.

Through the upper surface 9*a* of the path unit 9, ten ink supply openings 105*b* are made to receive ink from the ink tank 17. In the path unit 9, as FIG. 2 and FIG. 3 show, manifold paths 105 connected to the ink supply openings 105*b* and sub-manifold paths 105*a* branched from the manifold paths 105 are formed. The manifold paths 105 extend along the slopes of the trapezoidal actuator units 21 in plan view. Below the actuator unit 21, four sub-manifold paths 105*a* extend along the main scanning direction. These four sub-manifold paths 105*a* are branched from the manifold path 105 at one slope of the actuator unit 21, extend along the main scanning direction, and are connected to another manifold path 105 at the other slope. As shown in FIG. 3 and FIG. 4, the ejection surface 2*a* of the path unit 9 has many outlets 108 forming a matrix.

The pressure chambers 110 are formed on the surface of the path unit 9. The pressure chambers 110 are aligned in the long axis direction of the path unit 9 (i.e. in the main scanning direction), so that pressure chamber rows are formed. 16 pressure chamber rows are formed in the sub-scanning direction at equal intervals. The number of pressure chambers 110 in each of the pressure chamber rows decrease in the direction from the longer side (bottom side) to the shorter side (top side), in accordance with the outer shape (trapezoidal shape) of the actuator unit 21.

The outlets 108 are disposed to form outlet rows corresponding to the respective pressure chamber rows. In plan view, these outlet rows are disposed to be in parallel with one another to avoid the sub-manifold paths 105*a*.

As shown in FIG. 4, the path unit 9 is made up of nine metal plates 122-130 made of stainless steel. These plates 122-130 are aligned with one another and deposited, so that the manifold paths 105 connected to the ink supply openings 105*b* and many individual ink flow paths 132 are formed. The ink flow paths 132 pass through the manifold paths 105 connected to the ink supply openings 105*b*, the sub-manifold paths 105*a*, the ends of the sub-manifold path 105*a*, the pressure chambers 110, and the outlets 108 in this order. In each individual ink flow path 132, the pressure chamber 110 is provided substantially at the center of the path from the end of the sub-manifold path 105*a* to the outlet 108.

The ink flow in the path unit 9 will be described. As shown in FIG. 2 to FIG. 4, the ink supplied to the path unit 9 via the ink supply openings 105*b* flows from the manifold paths 105 to the sub-manifold paths 105*a*. The ink in the sub-manifold paths 105*a* flows into each individual ink flow path 132 and then reaches the outlet 108 via an aperture 112 which functions as an aperture and the pressure chamber 110.

Now the actuator units 21 will be described. As shown in FIG. 2, the four actuator units 21 are staggered to avoid the ink supply openings 105*b*. The opposing sides which are in parallel to each other of each actuator unit 21 extend along the long axis direction of the path unit 9, and a slope of one actuator unit 21 overlaps a slope of the neighboring actuator unit 21, in the width direction of the path unit 9 (i.e. in the sub-scanning direction).

Figure 5A:
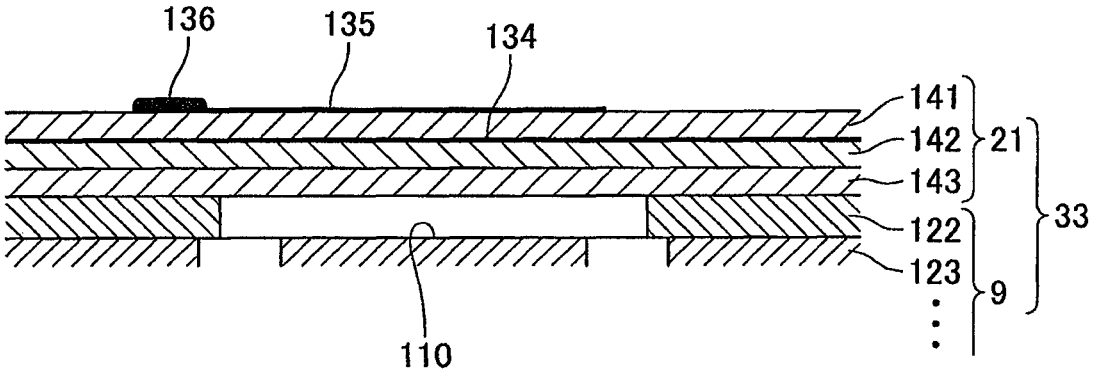
FIG. 5A is an enlarged cross section of the region indicated by an alternate long and short dash line in FIG. 4.

As shown in FIG. 5A, the actuator unit 21 is composed of three piezoelectric sheets 141-143 made of a lead zirconate titanate (PZT) ceramic material having ferroelectricity. Each of the piezoelectric sheets 141-143 is constituted by a single sheet which is shaped and sized to cover pressure chambers 110. The lower surface of the lowest piezoelectric sheet 143 is fixed to the path unit 9. The upper surface of the topmost piezoelectric sheet 141 opposes a COF (Chip On Film) 50 which is a flat flexible substrate. To oppose the pressure chambers 110 on the upper surface of the piezoelectric sheet 141, individual electrodes 135 are formed. The COF 51 is connected to the individual electrodes 135 as described later. Between the piezoelectric sheet 141 and the piezoelectric sheet 142 below the sheet 141, a common electrode 134 is formed to entirely cover these sheets.

Figure 5B:
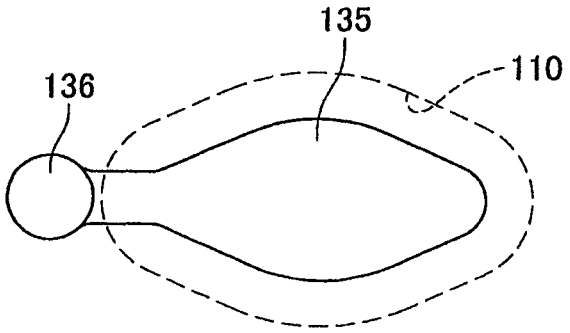
FIG. 5B is a plan view of an individual electrode.

As shown in FIG. 5B, the individual electrode 135 is substantially rhombic to be similar in shape to the pressure chamber 110 in plan view. In plan view, the most of the individual electrode 135 is covered with the pressure chamber 110. One acute angle portion of the rhombic individual electrode 135 juts out from the pressure chamber 110. At the jutting edge of the portion, an individual bump 136 is provided to protrude upward and this bump 136 is electrically connected to the individual electrode 135. On the piezoelectric sheet 141 is formed an individual bump for the common electrode. The common electrode 134 is electrically connected to the aforesaid individual bump via a conductor (not illustrated) in a through hole made through the piezoelectric sheet 141.

The common electrode 134 receives, via the individual bumps, a single ground potential at all regions corresponding all of the pressure chambers 110, respectively. On the other hand, the individual electrodes 135 are electrically connected to the respective output terminals of a later-described driver IC 52 via the COF 50, so that a drive signal is selectively supplied to the electrodes from the driver IC 52.

The piezoelectric sheet 141 is polarized in its thickness direction. When an electric field is applied to the piezoelectric sheet 141 in its polarization direction by differentiating the electric potential of the individual electrode 135 from that of the common electrode 134, the field application part corresponding to that individual electrode 135 functions as an active portion that warps on account of a piezoelectric effect. That is to say, the actuator unit 21 has actuators whose number is identical with the number of the pressure chambers 110, and each portion sandwiched between an individual electrode 135 and a pressure chamber 110 functions as an actuator. For example, in case where the field application direction is identical with the polarization direction, an active portion contracts in the direction orthogonal to the polarization direction (i.e. in the direction in parallel to the plane).

In this way, the actuator unit 21 is a so-called unimorph-type actuator in which a piezoelectric sheet 141 which is the upper single sheet distanced from the pressure chamber 110 is a layer including the active portion whereas piezoelectric sheets 142 and 143 which are the lower two sheets close to the pressure chamber 110 are inactive layers. On the contrary to the active layer, the inactive layers do not spontaneously warp in response to electric field application. As shown in FIG. 5A, the piezoelectric sheets 141-143 are fixed to the upper surface of the plate 122 which defines the borders of the pressure chambers 110. With this arrangement, when the degree of warping in the in-plane direction is different between the field application parts of the piezoelectric sheet 141 and the piezoelectric sheets 142 and 143 below those parts, the entirety of the piezoelectric sheets 141-143 undergo unimorph deformation so as to curve toward the pressure chamber 110.

Now, a control system for driving the actuator units 21 will be described with reference to FIG. 6. Receiving the input of image data, the control unit 100 outputs an ejection instruction to the driver IC 52 to cause the heads 1 to eject ink. Receiving the ejection instruction from the control unit 100, the driver IC 52 generates ejection drive signals based on the ejection instruction and outputs them to the actuator units 21. In so doing, the ejection drive signals are supplied to the individual electrodes 135.

Figure 7A:
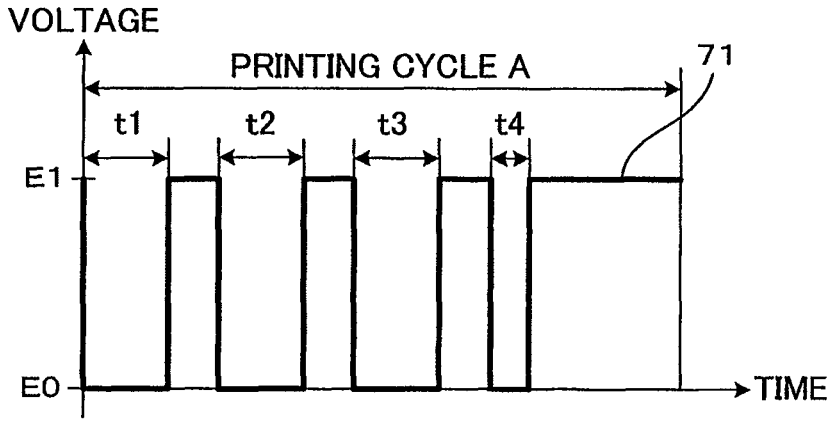
FIG. 7A shows an example of an ejection drive signal supplied to the actuator unit.

FIG. 7A shows an example of the ejection drive signals supplied to the individual electrodes 135. A signal 71 includes voltage pulse signals having rectangular pulses. The time length of this signal 71 is identical with a printing cycle A. This printing cycle A is a time required by the conveyor mechanism 16 to convey a sheet P for a unit distance corresponding to the printing resolution, in the conveyance direction of the media sheet P. For example, when signals 71 are supplied to the individual electrodes 135, a single signal 71 is supplied to a single individual electrode 135 each time the printing cycle A elapses.

The signal 71 includes four voltage pulse signals whose pulse widths are t1-t4. In each voltage pulse signal, the low-level voltage is E0 whereas the high-level voltage is E1. E0 is equal to the ground potential on the common electrode 134.

As the signal 71 is supplied to the individual electrode 135, the electric potential of the individual electrode 135 starts to change from E1 to E0 when the supply of the leading edge of the voltage pulse signal starts. After a predetermined transition period shorter than the pulse width has elapsed, the electric potential of the individual electrode 135 reaches E0. When the supply of the tail edge of the voltage pulse signal starts, the electric potential of the individual electrode 135 starts to change from E0 to E1. After a predetermined transition period has elapsed, the electric potential of the individual electrode 135 returns to E1. As such, the electric potential of the individual electrode 135 is not immediately changed but gradually changed over a predetermined transition period.

Figure 8A:
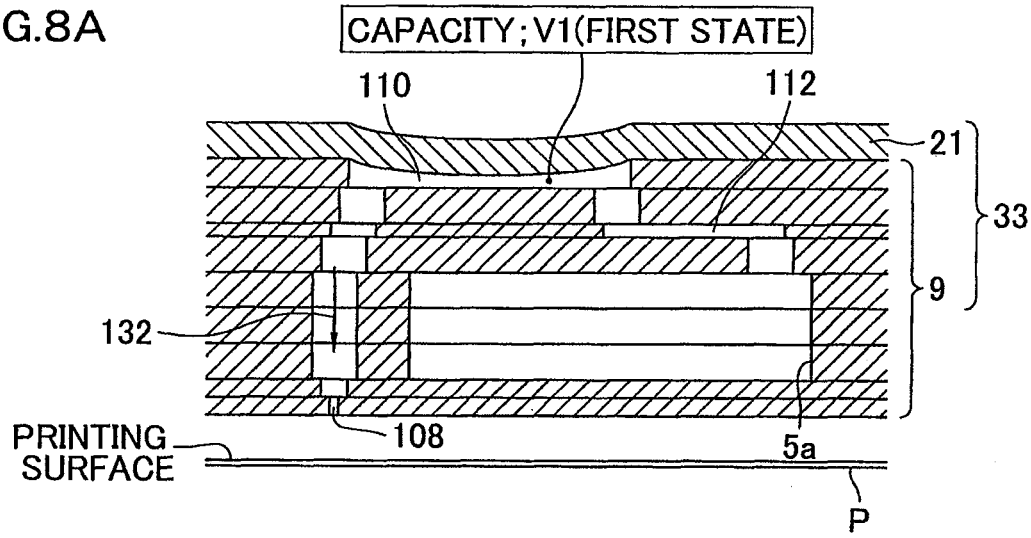
FIG. 8A to FIG. 8C are figures which show the operation of the actuator in response to an ejection pulse signal and correspond to FIG. 4.
Figure 8B:
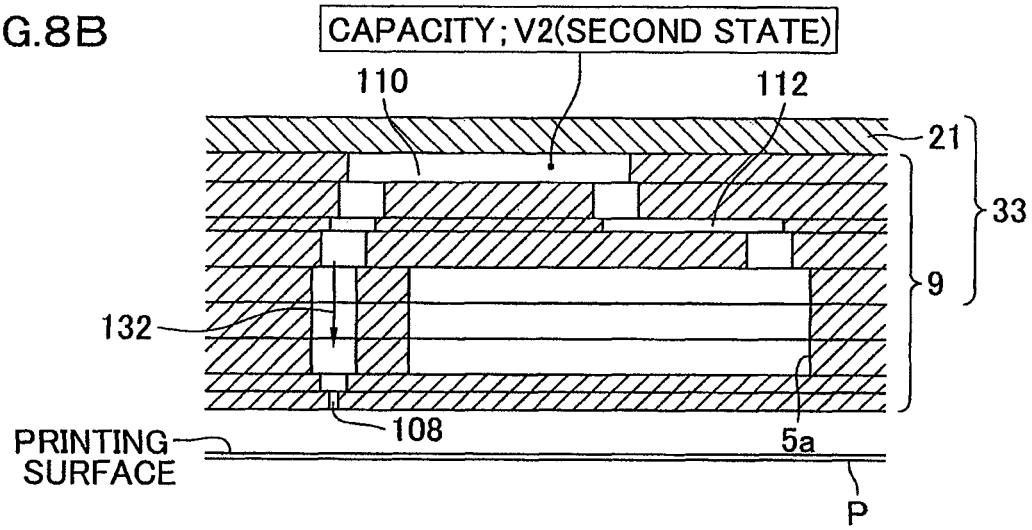
Figure 8C:
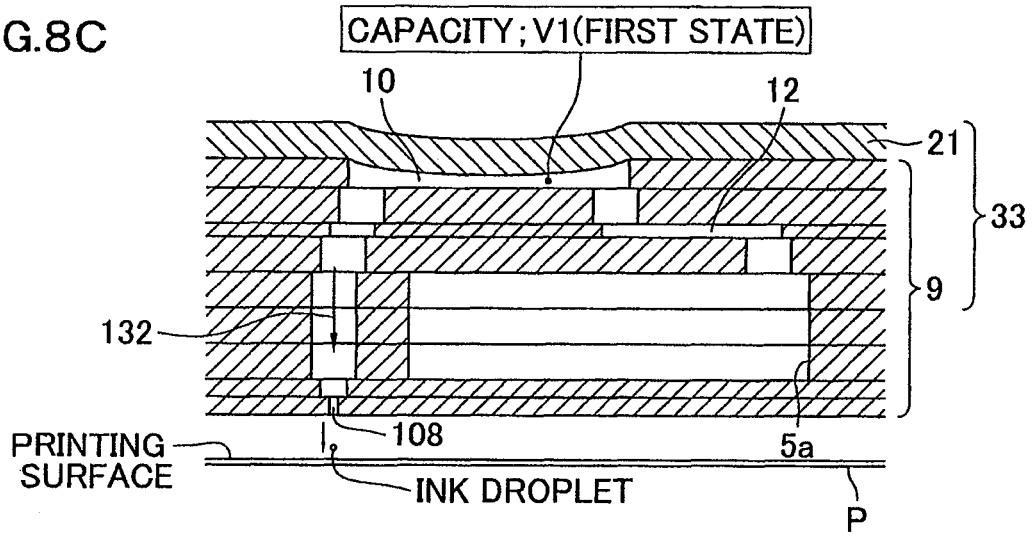

As a single voltage pulse signal is supplied, the actuator drives as shown in FIG. 8A-FIG. 8C, with the result that an ink droplet is ejected from the outlet 109.

FIG. 8A shows a case where the electric potential of the individual electrode 135 is at E1. The actuator is in a tension state and curves toward the pressure chamber 110. The capacity of the pressure chamber 110 in this state is V1, and this state is termed a first state of the actuator.

FIG. 8B shows a case where the electric potential of the individual electrode 135 is E0. The stress generated on the actuator is released and the actuator is substantially relaxed. The capacity V2 of the pressure chamber 110 in this state is larger than the capacity V1 of the pressure chamber 110 shown in FIG. 8A. This state is termed a second state of the actuator. As the capacity of the pressure chamber 110 is increased in this way, the pressure inside the pressure chamber 110 becomes negative and hence the ink is sucked into the pressure chamber 110 from the sub-manifold path 105*a*.

FIG. 8C shows a case where the electric potential of the individual electrode 135 returns to E1. The actuator in this state curves toward the pressure chamber 110 in the same manner as FIG. 8A. The actuator is in the first state. As the state of the actuator is changed from the second state shown in FIG. 8B to the first state shown in FIG. 8C, the ink inside the pressure chamber 110 receives a positive pressure. Whether an ink droplet is ejected from the outlet 109 depends on a timing to apply the positive pressure, the magnitude of the positive pressure, and the magnitude of the previously-applied negative pressure. If an ink droplet is ejected from the outlet 109 and impacts on the upper surface of a sheet P, a dot is formed on the sheet P.

Figure 9A:
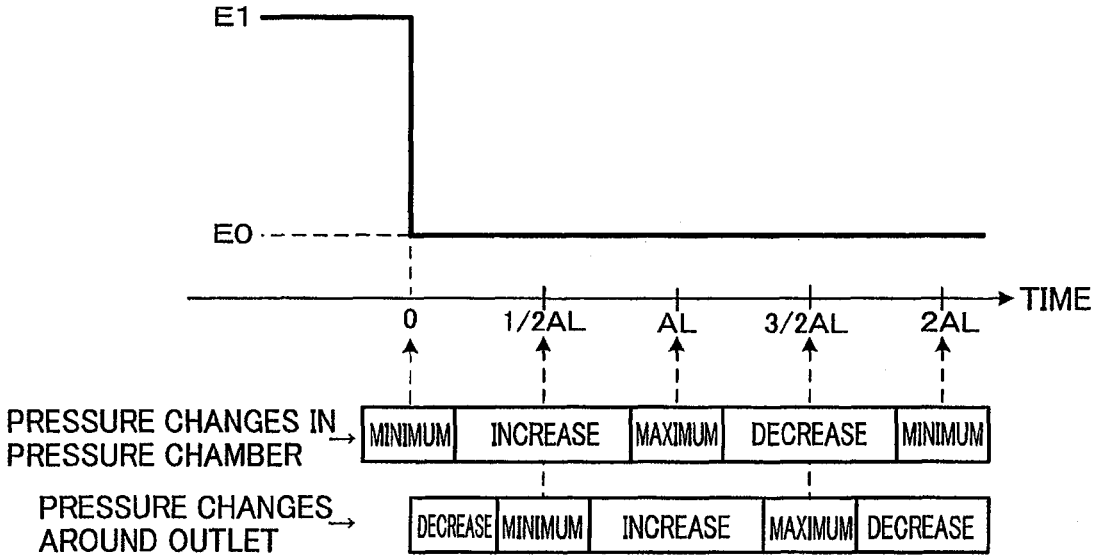
FIG. 9A shows how the pressure of ink inside a pressure chamber and the pressure of ink around the outlet are changed, when the electric potential on the individual electrode changes from E1 to E0.
Figure 9B:
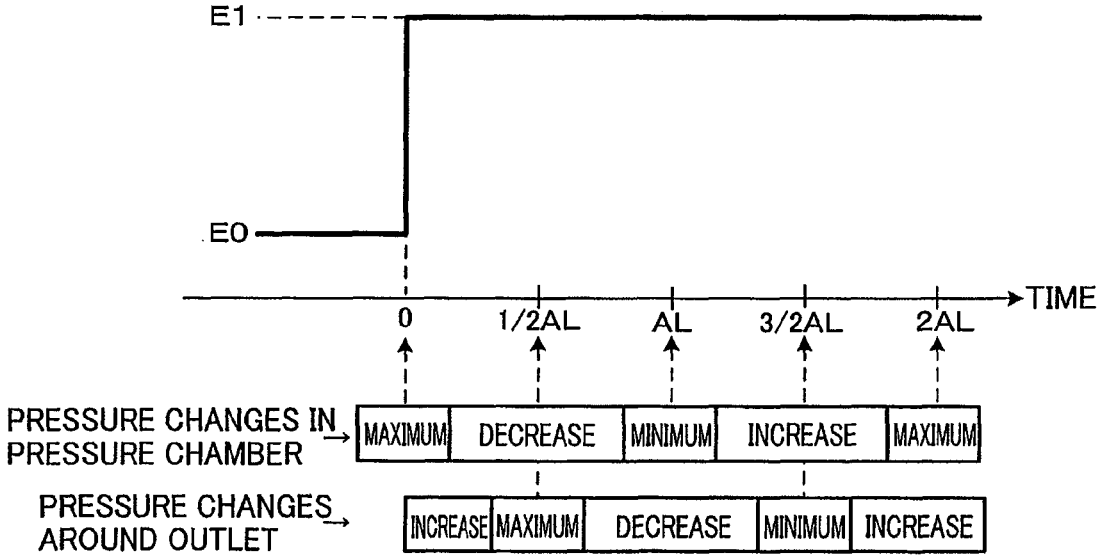
FIG. 9B shows how the pressure of ink inside a pressure chamber and the pressure of ink around the outlet are changed, when the electric potential on the individual electrode changes from E0 to E1.

Referring to FIG. 9A and FIG. 9B, a relationship between a timing to apply a pressure to ink in the pressure chamber 110 and ejection of an ink droplet. The time frame in FIG. 9A is arranged so that a time when the electric potential of the individual electrode 135 starts to change from E1 to E0 is the origin (time 0), whereas the time frame in FIG. 9B is arranged so that a time when the electric potential of the individual electrode 135 starts to change from E0 to E1 is the origin (time 0).

In the pressure chamber 110, a negative pressure is generated when the electric potential of the individual electrode 135 is changed from E1 to E0, and then the pressure gradually increases. For this reason, as shown in FIG. 9A, the pressure in the pressure chamber 110 is minimum at the time 0.

As the pressure in the pressure chamber 110 increases, the pressure in the pressure chamber 110 becomes positive from negative, and is maximized at a time when a time substantially equal to AL (Acoustic Length) elapses from the time 0. The AL is equivalent to a time length from a time when a pressure wave propagating in the ink leaves the end of the sub-manifold path 105*a* of the individual ink flow path 132 to a time when the pressure wave reaches the outlet 108. As a negative pressure is applied to the pressure chamber 110, the pressure propagates toward the both ends of the individual ink flow path 132, and then returns to the pressure chamber 110 as a positive pressure. The pressure chamber 110 is, as described above, provided substantially at the center of the path between the exit to the sub-manifold path 105*a* and the outlet 108 in the individual ink flow path 132. For this reason, a time length between a time when the pressure inside the pressure chamber 110 is minimum and a time when the pressure is maximum is substantially identical with the AL.

Thereafter, the pressure inside the pressure chamber 110 decreases, and is minimized when a time length substantially equal to 2AL elapses from the time 0. As such, the pressure inside the pressure chamber 110 alternately minimized and maximized each time AL elapses until the next pressure is applied, while the amplitude of the alternation is gradually attenuated.

In the meanwhile, as shown in FIG. 9A, the pressure on the ink near the outlet 108 is minimized when a time length of substantially 1/2AL has elapsed from the time 0. This is because the outlet 108 is separated from the pressure chamber 110 by a distance equivalent to 1/2AL. Thereafter, the pressure around the outlet 108 is maximized when a time length of substantially 3/2AL has elapsed from the time 0. In this way, the pressure around the outlet is alternately minimized and maximized each time a time length of an integral multiple of AL elapses from the time 1/2AL, while the amplitude of the alternation is gradually attenuated.

When the electric potential of the individual electrode 135 changes from E0 to E1, a positive pressure is generated in the pressure chamber 110, and then this pressure gradually decreases. Therefore, as shown in FIG. 9B, the pressure in the pressure chamber 110 is maximum at the time 0.

As the pressure in the pressure chamber 110 decreases, the pressure in the pressure chamber 110 becomes negative from positive, and the pressure in the pressure chamber 110 is minimized when a time length of substantially AL has elapsed from the time 0. Thereafter, the pressure inside the pressure chamber 110 increases and is maximized when a time length of substantially 2AL has elapsed from the time 0. As such, the pressure in the pressure chamber 110 is alternately maximized and minimized each time a time length of AL elapses until the next pressure is applied, while the amplitude of the alternation is gradually attenuated.

On the other hand, the pressure on the ink near the outlet 108 is, as shown in FIG. 9B, maximized when a time length of substantially 1/2AL has elapsed from the time 0. When a time length of substantially 3/2AL has elapsed from the time 0, the pressure around the outlet 108 is minimized. As such, the pressure around the outlet 108 is alternately maximized and minimized each time a time length of an integral multiple of AL elapses from the time 1/2AL, while the amplitude of the alternation is gradually attenuated.

Turning back to FIG. 7A, the following will describe how the widths t1-t3 of the respective voltage pulse signals of the signal 71 are arranged. In the present embodiment, the widths t1-t3 are all AL in the signal 71. This arrangement is equivalent to a case where, in each voltage pulse signal, after the change in the electric potential shown in FIG. 9A is conducted on the individual electrode 135, the change in the electric potential shown in FIG. 9B is conducted on the individual electrode 135 after a time length of AL has elapsed. In other words, at the time AL at which the pressure in the pressure chamber 110 is maximized for the first time in FIG. 9A, the maximum pressure of the time 0 in FIG. 9B is applied to the ink in the pressure chamber 110. Therefore the timings at each of which the pressure inside the pressure chamber 110 is maximized are synchronized with each other. As a result, the applied energy is sufficient for ejecting ink from the outlet 108. As such, each of the three voltage pulses having widths t1-t3 is equivalent to the ejection drive signal which instructs ink ejection from the outlet 108. In short, the signal 71 includes three ejection drive signals in total.

In the signal 71, the fourth pulse having the width t4, which is subsequent to the three pulses having the widths of t1-t3, has been adjusted in timing and pulse width to cancel the pressure applied by the preceding three pulses. This restrains the pressure by the three pulses from influencing on the ink ejection by the next pressure application. The signal 71, which achieves ink ejection from the outlet 108 by three pulses, may be differently arranged so that the number of pulses for ink ejection is 1, 2, 4, or more.

By the way, when a period in which ink ejection from the outlet 108 is not carried out continues, the viscosity of the ink around the outlet 108 may be increased on account of the physical properties of the compositions of the ink and on account of the dryness of the ink. The increase in the viscosity due to the former reason is restrained by so-called thixotropy which is the property of ink whereby the viscosity is reduced when agitated. The increase in the viscosity due to the latter reason is restrained in such a way that the ink is agitated to mix the ink which is far from the outlet 108 and has high water content with the dry ink around the outlet 108.

A conventional scheme to prevent the increase in the ink viscosity is such that the actuator unit 21 is driven to the extent that ink is not ejected from the outlet 108 so as to slightly vibrate and mix the ink around the outlet 108. In the present embodiment, apart from the ejection drive signals such as those of the signal 71, a non-ejection drive signal which is a voltage pulse signal whose pulse width is adjusted not to cause ink ejection is supplied to the individual electrode 135.

Figure 6:
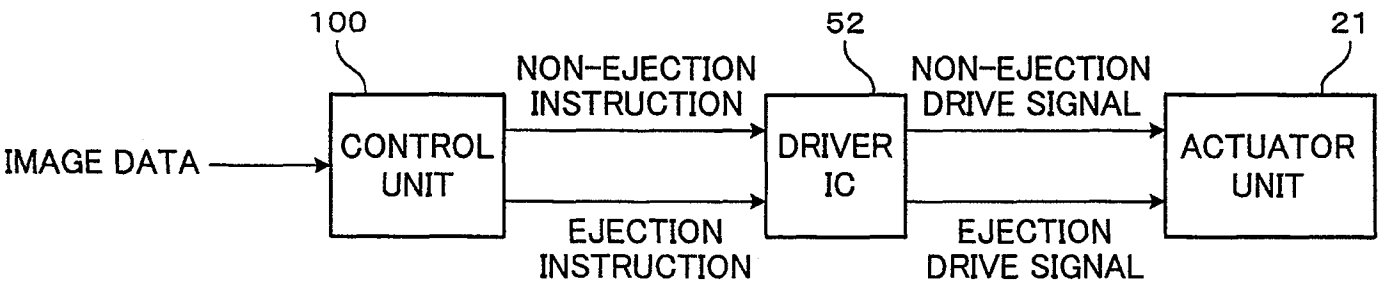
FIG. 6 is a block diagram of a control system which drives an actuator unit.

More specifically, the control unit 100 outputs a non-ejection instruction to the driver IC 52 during a period in which ink ejection from the outlet 108 is not carried out (see FIG. 6). Receiving the non-ejection instruction from the control unit 100, the driver IC 52 supplies, to the actuator unit 21, a non-ejection drive signal which is adjusted not to cause ink ejection from the outlet 108. This non-ejection drive signal may also be supplied, for example, during a period in which the printing process is not conducted. In this case, it is preferable that many non-ejection drive signals be supplied repeatedly and continuously to the actuator unit 21 during the period in which the printing process is not conducted. Furthermore, even in a period in which the printing process is conducted, if there is an outlet 108 which does not eject ink for a certain period of time, in this period of time a non-ejection drive signal may be supplied to drive the actuator corresponding to that outlet 108.

Assume that, as non-ejection drive signals, voltage pulse signals having the same pulse widths are supplied to the individual electrode 135 at the same intervals. In this case, a pressure is regularly and orderly applied to the ink in the pressure chamber 110, with the result that the ink around the outlet 108 is orderly vibrated. However, the ink around the outlet 108 is not always uniformly vibrated at all parts thereof, and the degree of vibration may be different among the parts of the ink. When there is a difference in the degree of vibration among the parts, such a difference is hardly resolved only by continuing regular vibration. If there is a part where ink is not mixed very much by regular vibration, the viscosity of the ink in this part increases due to the thixotropy. As the ink viscosity increases in a part of the ink in this way, a convective flow hardly occurs in the entirety of the ink around the outlet 108, with the result that dry ink is not stirred and further increase in the viscosity is induced.

Figure 7B:
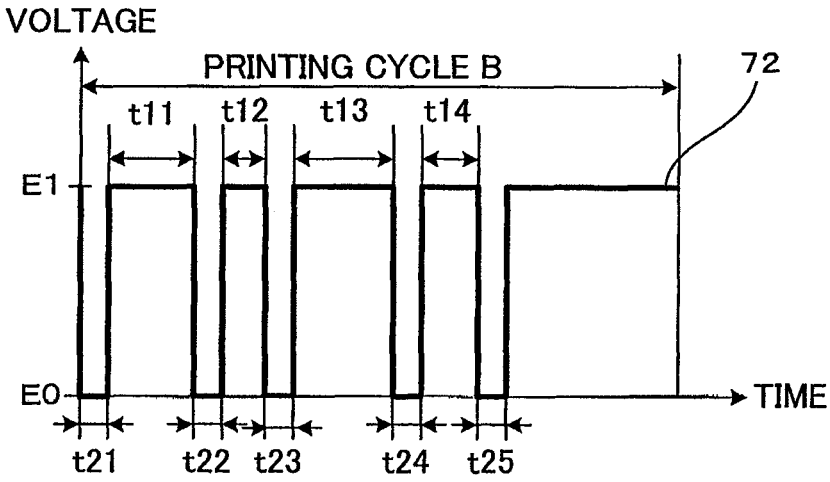
FIG. 7B is an example of a non-ejection drive signal supplied to the actuator unit.

To tackle this problem, the present embodiment is arranged so that a signal in which pulses are at different intervals, such as the signal 72 shown in FIG. 7B, is used for stirring the ink around the outlet 108 as irregularly as possible. Now this signal 72 will be discussed below.

The signal 72 is a signal including five voltage pulse signals having rectangular pulses and whose pulse widths are t21-t25, respectively. The signal 72 has the same temporal length as a printing cycle B. For example, when signals 72 are supplied to the individual electrode 135, a single signal 72 is supplied to one individual electrode 135 each time the printing cycle B elapses.

The printing cycle B is either identical with or different from the printing cycle A of the signal 71. For example, when the printing cycle B is shorter than the printing cycle A, the ink viscosity is rapidly decreased because many voltage pulse signals are supplied to the individual electrode 135 in a short period of time.

In each voltage pulse signal of the signal 72, the low-level voltage is E0 whereas the high-level voltage is E1. In the present embodiment, the pulse widths t21-t25 are identical with one another. A combination of voltage and pulse width is determined so as not to cause the outlet 108 to eject ink when the signal is supplied to the individual electrode 135. As such, ink ejection is certainly prevented for all voltage pulse signals by setting the pulse widths t21-t25 to be identical to one another.

Figure 10A:
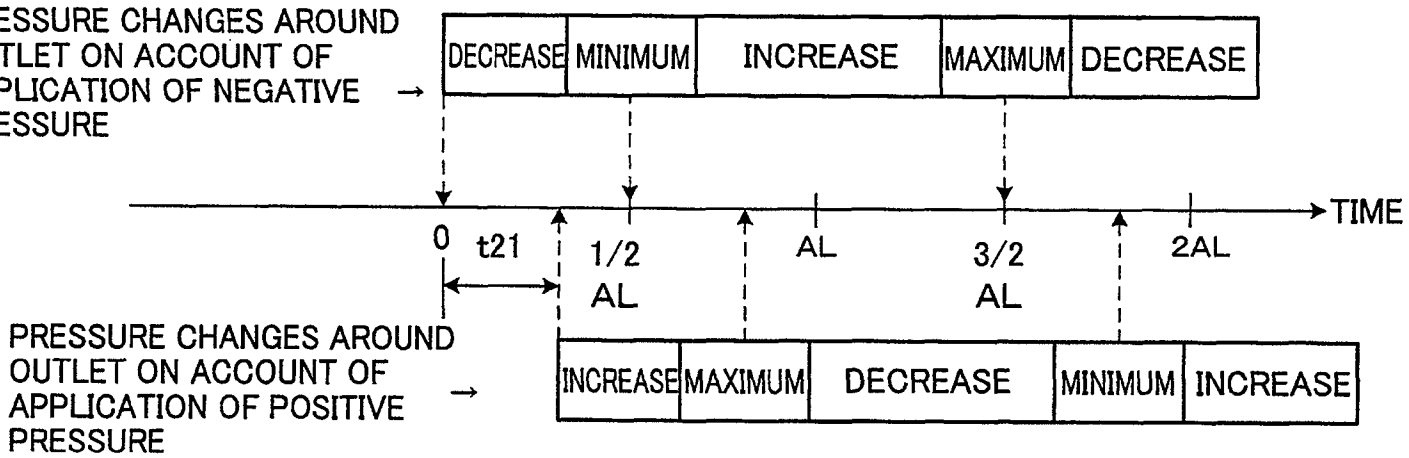
FIG. 10A and FIG. 10B show how the pressure around the outlet is changed when the individual electrode receives a voltage pulse signal which is a type of non-ejection drive signals.

In one example (hereinafter, Example A), each of the pulse widths t21-t25 is 2 μs when AL=6 μs (microseconds). In Example A, when only one of the voltage pulse signals is supplied to the individual electrode 135, the pressure around the outlet 108 is varied as shown in FIG. 10A. The time frame in FIG. 10A is arranged so that the origin (time 0) is a time at which the electric potential of the individual electrode 135 starts to change from E1 to E0 in response to the supply of a single voltage pulse signal. Since the pulse widths t21-t25 are equivalent to a time from the application of a negative pressure to the pressure chamber 110 to the application of a positive pressure, the application of positive pressure starts at the time 1/3AL in Example A. In so doing, as shown in FIG. 10A, a timing at which the pressure is maximized on account of the application of negative pressure is deviated from a timing at which the pressure is maximized on account of the application of positive pressure. In other words, since the timings at each of which the pressure is maximized are not overlapped, ink ejection from the outlet 108 is restrained.

Furthermore, as a whole, timings of pressure changes due to the application of negative pressure are deviated from timings of pressure changes due to the application of positive pressure. For this reason, for example the time 1/2AL in FIG. 10A is not only a timing at which the negative pressure is minimized in the pressure changes due to the application negative pressure but also a timing at which a positive pressure increases in the pressure changes on account of the application of positive pressure. Therefore, around the outlet 108, the application of negative pressure draws the ink back whereas the application of positive pressure pushes the ink. Because these opposite effects simultaneously occur, the ink around of the outlet 108 is suitably stirred.

Figure 10B:
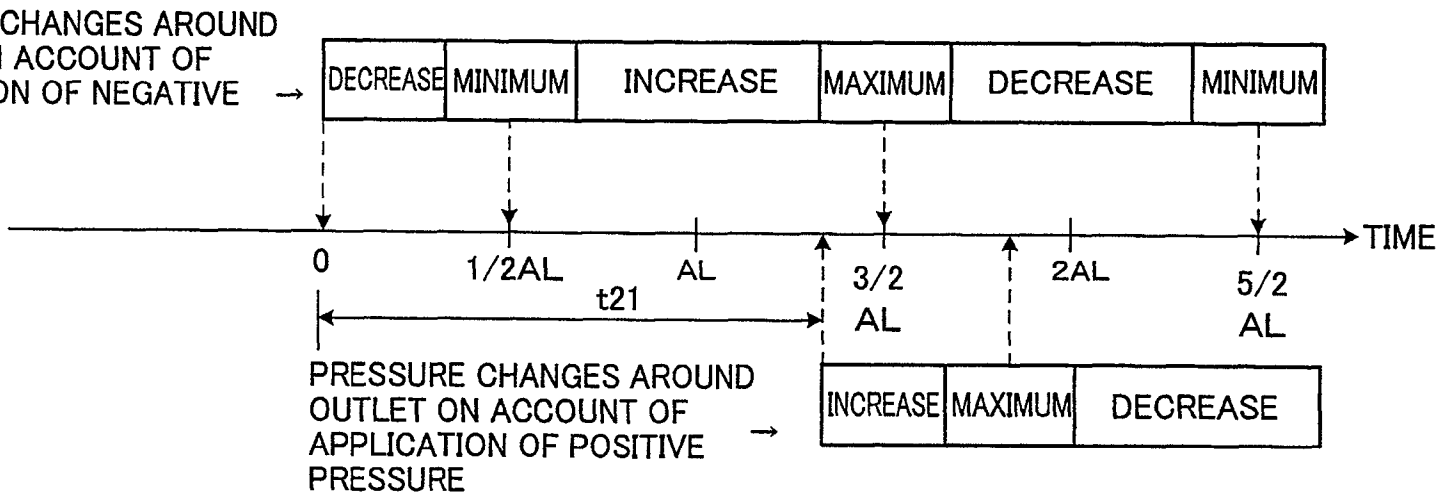

In another example (hereinafter, Example B), each of the pulse widths t21-t25 is 8 μs when AL=6 μs (microseconds). In the Example B, when only one of the voltage pulse signals is supplied to the individual electrode 135, the pressure around the outlet 108 is varied as shown in FIG. 10B. The time frame in FIG. 10B is arranged so that the origin (time 0) is a time at which the electric potential of the individual electrode 135 starts to change from E1 to E0 in response to the supply of a single voltage pulse signal. In Example B, the application of positive pressure starts at the time 4/3AL. In this case, as shown in FIG. 10B, the timings at which the pressure is maximized on account of the application of negative pressure are deviated from the timings at which the pressure is maximized on account of the application of positive pressure. In other words, since the timings at each of which the pressure is maximized are not overlapped between two types of pressure changes, ink ejection from the outlet 108 is restrained.

In this way, as a whole the timings of pressure changes on account of the application of negative pressure are deviated from the timings of pressure changes on account of the application of positive pressure, and hence the timings of negative pressure in one pressure change coincide with the timings of positive pressure in the other pressure change in Example B, in the same manner as Example A. This makes it possible to suitably stir the ink around the outlet 108.

Comparing Example A with Example B, a deviation between the timings at which the pressure is maximized in the pressure changes on account of the application of negative pressure and the timings at which the pressure is maximized in the pressure changes on account of the application of positive pressure is larger in Example A than in Example B. The ink ejection from the outlet 108 is likely to occur when the timings of maximum pressure are overlapped between the two types of pressure changes. On the other hand, the more the timings of maximum pressure are deviated from each other between the two types, the more the ink ejection from the outlet 108 is restrained. Therefore ink ejection is less likely to occur in Example A than Example B. Whether ink is ejected or not also depends on reasons such as the shape of the individual ink flow path 132 and the height of each pulse of the voltage pulse signal (i.e. difference between E0 and E1). For example, provided that the conditions other than the pulse widths are equal, each of the pulse widths t21-t25 is preferably 2 μs or less, when ink ejection occurs in Example B whereas ink ejection does not occur in Example A. Alternatively, each of the pulse widths t21-t25 is required to be 8 μs or longer.

As such, in the signal 72, each of the voltage pulse signals having the widths of t21-t25 is equivalent to a non-ejection drive signal which has been adjusted not to cause the outlet 108 to eject ink. In other words, the signal 72 includes five non-ejection drive signals in total, as a single block. It is noted that, in the signal 72, the pulse widths t21-t25 are equivalent to the time length from a timing at which the actuator shifts from the first state to the second state to a timing at which the actuator returns to the first state from the second state.

Turning back to FIG. 7B, an interval between neighboring voltage pulse signals of the signal 72 will be described. As shown in FIG. 7B, the intervals t11-T14 of the voltage pulse signals are different from one another. In one example (hereinafter, Example C), as shown in FIG. 11A, FIG. 11B, FIG. 12A, and FIG. 12B, t11=6 μs, t12=3 μs, t13=8 μs, and t14=4 82 s when AL=6 μs. In all of FIG. 11A, FIG. 11B, FIG. 12A, and FIG. 12B, the time frame is arranged so that the origin (time 0) is a timing at which a positive pressure is applied.

Figure 11A:
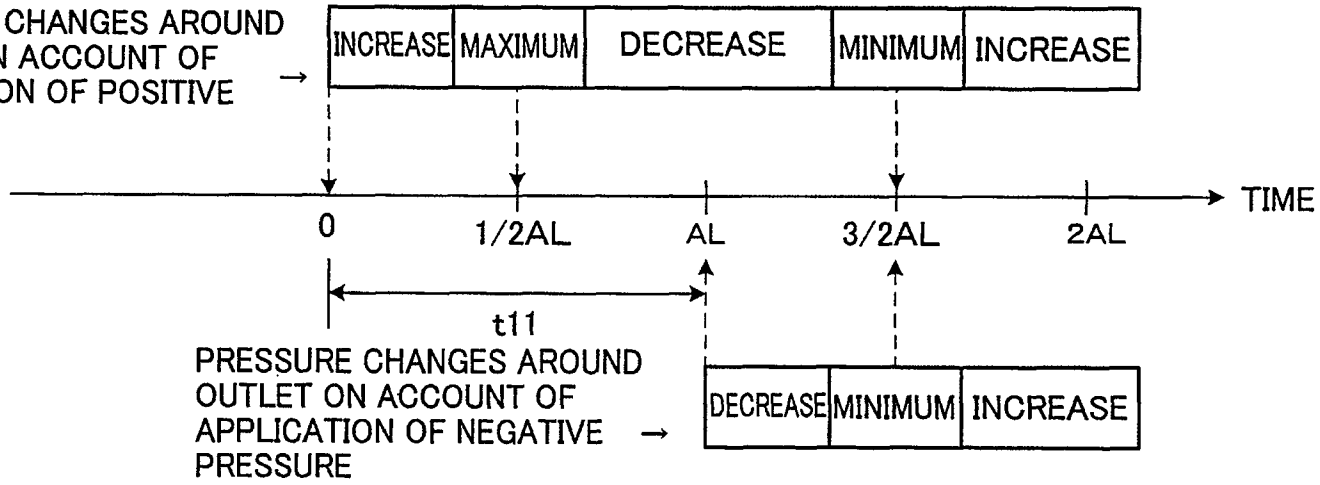
FIG. 11A and FIG. 11B show how the pressure around the outlet is changed when the individual electrode receives voltage pulse signals, in an example in which the voltage pulse signals are at different intervals.

FIG. 11A shows two types of pressure changes (i) and (ii) when two voltage pulse signals are supplied with t11=6 μs being interposed therebetween. The pressure changes (i) are pressure changes around the outlet 108 in response to the application of positive pressure by the first voltage pulse signal. The pressure changes (ii) are pressure changes around the outlet 108 in response to the application of negative pressure by the second voltage pulse signal. Since t11 is equal to AL, the timings (time 3/2AL) of minimum pressure in the respective pressure changes coincide with each other. However, since the timing of maximum pressure is later than this timing by AL, the vibration of the ink is attenuated at this timing, and hence ink ejection from the outlet 108 is restrained.

Figure 11B:
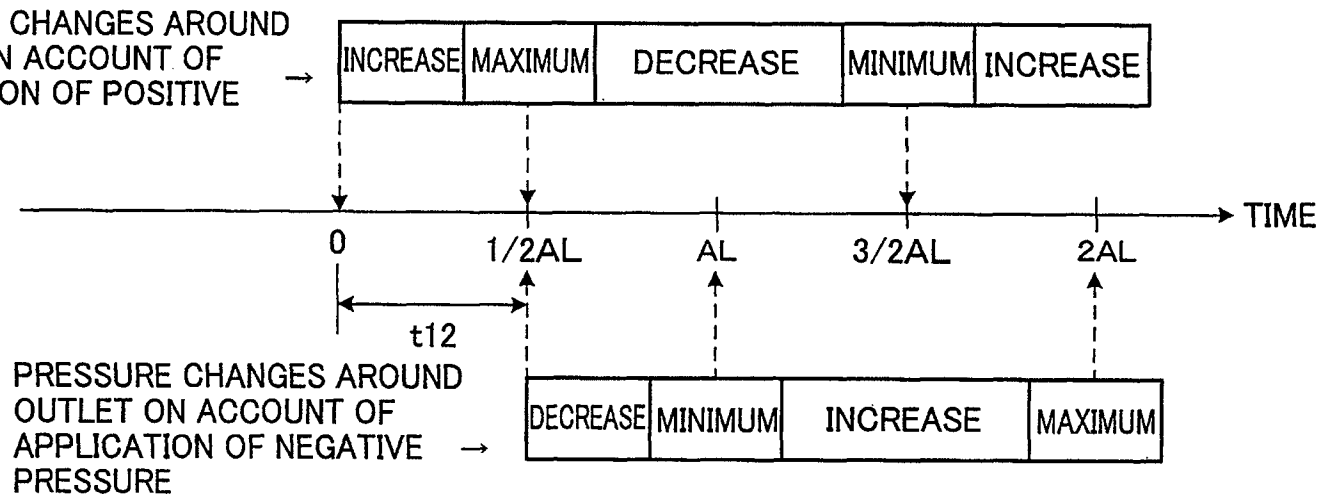

FIG. 11B shows two types of pressure changes (i) and (ii) when two voltage pulse signals are supplied with t12=3 μs being interposed therebetween. The pressure changes (i) are pressure changes around the outlet 108 in response to the application of positive pressure by the first voltage pulse signal. The pressure changes (ii) are pressure changes around the outlet 108 in response to the application of negative pressure by the second voltage pulse signal. As a whole the timings of pressure changes due to the application of positive pressure are deviated from the timings of pressure changes due to the application of negative pressure. Therefore, for example, the timing of positive pressure in the pressure changes by one pressure application coincides with the timing of negative pressure in the pressure changes by the other pressure application, during a period from the time 1/2AL to the time AL. In this case, the ink around the outlet 108 receives both a positive pressure to eject the ink and a negative pressure to draw the ink back. This makes it possible to suitably stir the ink around the outlet 108.

Figure 12A:
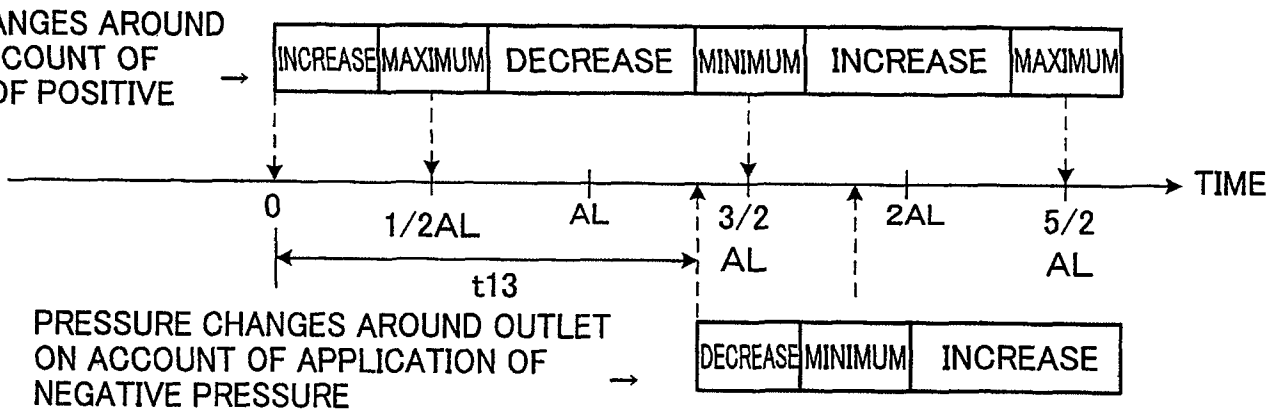
FIG. 12A and FIG. 12B show how the pressure around the outlet is changed when the individual electrode receives voltage pulse signals, in an example in which the voltage pulse signals are at different intervals.

FIG. 12A relates to a case where two voltage pulse signals are supplied with t13=8 μs being interposed therebetween, and shows pressure changes around the outlet 108 in response to the application of positive pressure on account of the first voltage pulse signal and pressure changes around the outlet 108 in response to the application of positive pressure on account of the second voltage pulse signal. As shown in FIG. 12A, the timings of pressure changes on account of the application of positive pressure are on the whole deviated from the timings of pressure changes on account of the application of negative pressure. For this reason, also in this case the timing of positive pressure in the pressure changes in one pressure application coincides with the timing of negative pressure in the pressure changes in the other pressure application. This makes it possible to suitably stir the ink around the outlet 108.

Figure 12B:
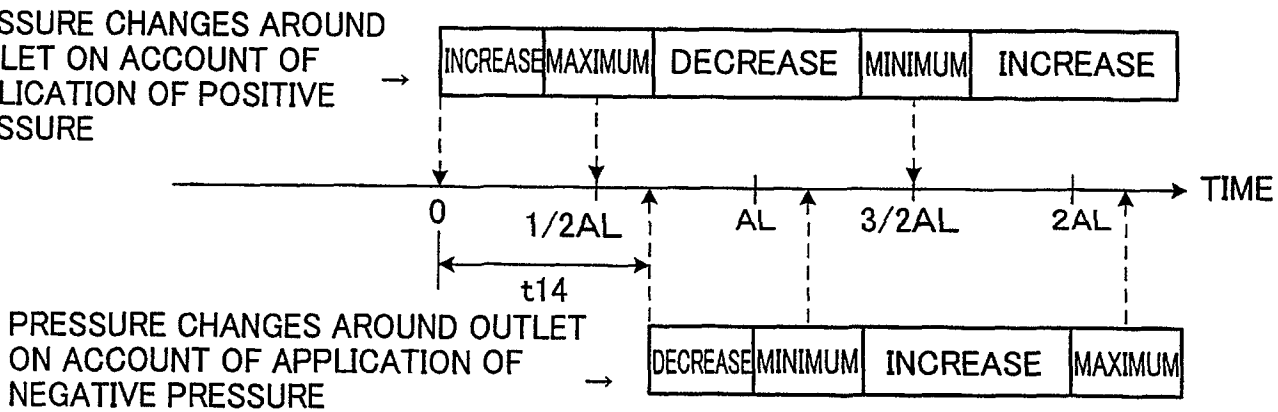

FIG. 12B shows two types of pressure changes (i) and (ii) when two voltage pulse signals are supplied with t14=4 μs being interposed therebetween. The pressure changes (i) are pressure changes around the outlet 108 in response to the application of positive pressure by the first voltage pulse signal. The pressure changes (ii) are pressure changes around the outlet 108 in response to the application of negative pressure by the second voltage pulse signal. As shown in FIG. 12B, the timings of pressure changes on account of the application of positive pressure are on the whole deviated from the timings of pressure changes on account of the application of negative pressure. For this reason, also in this case the timing of positive pressure in the pressure changes in one pressure application coincides with the timing of negative pressure in the pressure changes in the other pressure application. This makes it possible to suitably stir the ink around the outlet 108.

The intervals t11-t14 are preferably determined in consideration of to what extent the pressure changes on account of the application of positive pressure are liable to attenuate. For example, in case where the pressure changes on account of the application of positive pressure almost completely attenuate and the vibrations around the outlet 108 are substantially nullified after a time of 2AL or longer elapses from the timing of the positive pressure application, the ink is not suitably stirred even if a negative pressure is applied after the time of 2AL has elapsed. In this case, each of the intervals t11-t14 is arranged to be shorter than 2AL.

In the embodiment described above, when the signal 72 is supplied to the individual electrode 135, the voltage pulse signals which are t-21-t25 wide with which no ink ejection occurs cause the ink around the outlet 108 to vibrate to the extent of not being ejected.

The intervals t11-t14 of the voltage pulse signals are arranged to be different from one another. For example, t11=6 μs, t12=3 82 s, t13=8 μs, and t14=4 μs in Example C above. Since the intervals of the voltage pulse signals repeatedly increase and decrease over time, it is possible to irregularly vibrate the ink around the outlet 108. As a result, a vibrating region in the ink around the outlet 108 is irregularly changed. For this reason, even if the degree of the stirring is different among the regions, the distribution of the degrees of the stirring is not fixed but irregularly changed, and hence there is hardly a non-stirred region and the ink viscosity is rapidly reduced.

Furthermore, as described above, Example A and Example B are arranged so that ink is drawn back by the application of negative pressure but the ink is then pushed by the subsequent application of positive pressure, and hence the ink around the outlet 108 is suitably stirred. In Example C, the intervals of the voltage pulse signals are adjusted so that the ink is pushed by the application of positive pressure but then the ink is drawn back by the subsequent application of negative pressure, and hence the ink around the outlet 108 is suitably stirred.

A suitable embodiment of the present invention has been described above. The present invention, however, is not limited to the embodiment above and can be variously modified.

For example, the embodiment above is arranged so that the pulse widths t21-t25 of the respective voltage pulse signals which are non-ejection drive signals in the signal 72 are identical with one another. Alternatively, at least two of the signal widths t21-t25 may be different from one another. In this case, the ink around the outlet 108 is irregularly vibrated and the increase in the ink viscosity is effectively restrained by making the pulse widths different from one another in the same manner as making the intervals of the voltage pulse signals different from one another. On the contrary to the embodiment above, only the pulse widths may be made different from one another while the intervals of the voltage pulse signals are the same as one another.

The embodiment above assumes that the signal 72 including five voltage pulse signals is repeatedly and continuously supplied to the individual electrode 135. Alternatively, a signal including less than five voltage pulse signals may be supplied or a signal including six or more voltage pulse signals may be supplied. Furthermore, in the embodiment above the intervals t11-t14 of the voltage pulse signals may be different from one another in a single signal 72. Alternatively, only two of the intervals t11-t14 may be different from one another, or three of them may be different from one another. Moreover, voltage pulse signals may be supplied to the individual electrode 135 not as a single block but one by one at temporal intervals which are randomly determined in advance. In other words, any type of supply method is employable as long as the voltage pulse signals are supplied to the individual electrode 135 while the intervals of the signal are increased and decreased.

In the embodiment above, the pulse height (difference between E0 and E1) of the voltage pulse signal is fixed. This pulse height, however, may be variable. In this case, it becomes easy to choose the pulse width as a non-ejection drive signal because the adjustment of the voltage pulse signal not to induce ink ejection from the outlet 108 can also be achieved by adjusting the pulse height.

The embodiment above is an example in which the present invention is employed in inkjet heads which eject ink from nozzles. However, the application for the present invention is not limited to such inkjet heads. For example, the present invention is employable for a droplet ejection head by which, for example, a conductive paste is ejected to form a fine wiring pattern on a substrate, an organic light emitter is ejected onto a substrate to form a high-definition display, or optical resin is ejected onto a substrate to form a microelectronic device such as an optical waveguide.

Although the actuator of the present embodiment is a piezoelectric type, an electrostatic type or a type using electric resistance heating may also be employable.

What is claimed is:

1. A recording apparatus comprising:

a record head which includes an outlet to eject a liquid, a pressure chamber connected to the outlet, and an actuator which is selectively switchable between a small-capacity state in which the capacity of the pressure chamber is V1 and a large-capacity state in which the capacity of the pressure chamber is V2 which is larger than V1; and a head driving unit which selectively supplies, to the actuator, ejection drive signals which change the state of the actuator so that the liquid is ejected from the outlet and non-ejection drive signals by which the state of the actuator is changed from the small-capacity state to the large-capacity state and then returns to the small-capacity state, to the extent that no ejection of the liquid occurs from the outlet, wherein, the head driving unit supplies the non-ejection drive signals to the actuator within a single printing cycle, such that, within the single printing cycle, at least one of the following conditions is satisfied:

(i) a first time is different for each of the non-ejection drive signals, the first time being a time from an increase timing at which the state of the actuator is changed from the small-capacity state to the large-capacity state to a decrease timing at which the state of the actuator is changed from the large-capacity state to the small-capacity state; and (ii) a second time is different from another second time, the second time and the other second time each being a time ranging from an input of a non-ejection drive signal to an input of a directly-subsequent non-ejection drive signal.

2. The recording apparatus according to claim 1, wherein, the head driving unit supplies the non-ejection drive signals so that, during a period in which a pressure that the actuator applies to the liquid in the pressure chamber at the increase timing exerts a force onto a part of the liquid which part is around the outlet in a direction of pushing the part out from the outlet, a pressure that the actuator applies to the liquid in the pressure chamber at the decrease timing after the increase timing exerts a force onto the part of the liquid in a direction of drawing the part back into the outlet.

3. The recording apparatus according to claim 1, wherein, the head driving unit supplies the non-ejection drive signals so that, during a period in which a pressure that the actuator applies to the liquid in the pressure chamber at the decrease timing exerts a force onto a part of the liquid which part is around the outlet in a direction of drawing the part back into the outlet, a pressure that the actuator applies to the liquid in the pressure chamber at the increase timing after the decrease timing exerts a force onto the part of the liquid in a direction of pushing the part out from the outlet.

4. The recording apparatus according to claim 1, wherein, the head driving unit successively supplies the non-ejection drive signals to the actuator while keeping the first time unchanged and repeatedly increasing and decreasing the second time in length.

5. The recording apparatus according to claim 1, wherein, the head driving unit repeatedly supplies a signal to the actuator, the signal being arranged so that the non-ejection drive signals form a single block, and that the second time which is an interval between adjacent ones of the non-ejection drive signals is different at least once among the non-ejection drive signals.

6. The recording apparatus according to claim 5, wherein, the non-ejection drive signals are arranged so that the second time which is an interval between adjacent ones of the non-ejection drive signals is different among all of the non-ejection drive signals of a single printing cycle.

* * * * *